US009836022B2

(12) United States Patent
Himeno

(10) Patent No.: US 9,836,022 B2
(45) Date of Patent: Dec. 5, 2017

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Satoshi Himeno, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/207,696

(22) Filed: Jul. 12, 2016

(65) Prior Publication Data

US 2017/0023893 A1 Jan. 26, 2017

(30) Foreign Application Priority Data

Jul. 21, 2015 (JP) ..... 2015-144055

(51) Int. Cl.
*G03G 21/20* (2006.01)
*G03G 15/20* (2006.01)
*G03G 15/00* (2006.01)

(52) U.S. Cl.
CPC ..... *G03G 21/20* (2013.01); *G03G 15/2028* (2013.01); *G03G 15/6573* (2013.01)

(58) Field of Classification Search
None
See application file for complete search history.

(56) References Cited

U.S. PATENT DOCUMENTS

2003/0044208 A1* 3/2003 Kouno ..... B65H 29/12 399/406
2005/0220520 A1* 10/2005 Kawamoto ..... G03G 15/6576 399/405
2007/0201892 A1* 8/2007 Ando ..... G03G 15/6573 399/68
2011/0222942 A1 9/2011 Himeno

* cited by examiner

*Primary Examiner* — Thomas Giampaolo, II
(74) *Attorney, Agent, or Firm* — Amin, Turocy & Watson LLP; Gregory Turocy

(57) ABSTRACT

In accordance with an embodiment, an image forming apparatus comprises a fixing device configured to enable an image to be fixed on an image receiving medium passing through a nip between a heating section and a pressurizing section through heat of the heating section and pressurization of the pressurizing section; and a conveyance roller arranged at the downstream side of the fixing section in a conveyance direction of the image receiving medium and initially convey the fixed image receiving medium. The conveyance roller comprises an axis part; a plurality of large-diameter parts each configured to have an outer diameter larger than that of the axis part; and a plurality of small-diameter parts each configured to have an outer diameter which is larger than that of the axis part and smaller than that of the large-diameter part.

6 Claims, 4 Drawing Sheets

IMAGE FORMING APPARATUS

CROSS-REFERENCE TO RELATED APPLICATION

This application is based upon and claims the benefit of priority from Japanese Patent Application No. 2015-144055, filed Jul. 21, 2015, the entire contents of which are incorporated herein by reference.

FIELD

Embodiments described herein relate generally to an image forming apparatus.

BACKGROUND

Conventionally, there is an image forming apparatus such as a Multi-Function Peripheral (hereinafter, referred to an "MFP"). The image forming apparatus includes a fixing device. The fixing device fixes a toner image on a sheet serving as an image receiving medium through a heat fixing method. The fixing device is equipped with a fixing member and a press roller. For example, the shape of the fixing member, which is identical to that of a heat roller or a fixing belt, is cylindrical. A nip is formed between the fixing member and the press roller. The MFP enables the sheet on which the toner image is formed to pass through the nip between the press roller and the fixing member the temperature of which reaches a fixing temperature. In a conveyance direction of the sheet, a conveyance roller for conveying the sheet is arranged at the downstream side of the fixing device.

DETAILED DESCRIPTION

Figure 1:
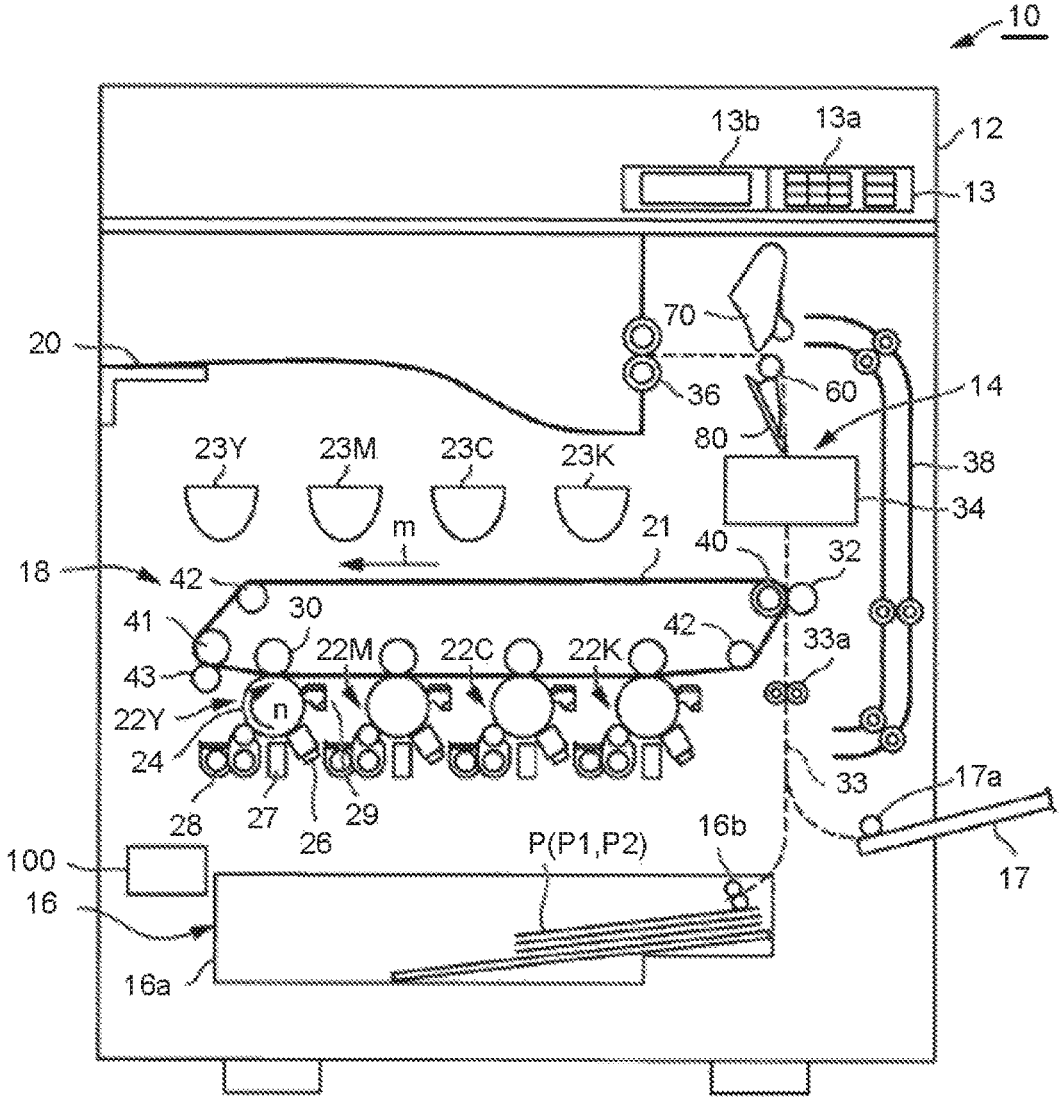
FIG. 1 is a side view of an image forming apparatus according to an embodiment.

Dew condensation is generated in the conveyance roller through water vapor generated at the time the sheet is heated at the nip, such as during the fixing process. If the dew condensation is generated in the conveyance roller, there is a possibility that the sheet is undesirably moistened at the time of conveying the sheet.

In accordance with an embodiment, an image forming apparatus comprises a fixing device and a conveyance roller. The fixing device, through heat of a heating section and pressurization of a pressurizing section, enables an image to be fixed on an image receiving medium passing through a nip between the heating section and the pressurizing section. The conveyance roller is arranged at the downstream side of the fixing device in the conveyance direction of the image receiving medium. The conveyance roller initially conveys the fixed image receiving medium. The conveyance roller comprises an axis part, a large-diameter part and a small-diameter part. The axis part is made from metal. The large-diameter part has an outer diameter larger than that of the axis part and larger than that of the small-diameter part. A plurality of the large-diameter parts are arranged around the axis part. The small-diameter part has an outer diameter which is larger than that of the axis part and smaller than that of the large-diameter part. A plurality of the small-diameter parts are arranged around the axis part.

Hereinafter, the image forming apparatus according to the embodiment is described with reference to the accompanying drawings. Furthermore, the identical components in each figure are applied with the identical reference numerals.

FIG. 1 is a side view of an image forming apparatus 10 according to the embodiment. Hereinafter, an MFP 10 is described as an example of the image forming apparatus 10.

As shown in FIG. 1, the MFP 10 is equipped with a scanner 12, a controller panel 13 and a main body section 14. The scanner 12, the controller panel 13 and the main body section 14 each are equipped with a control section. The MFP 10 is equipped with a system control section 100 serving as a control section for collectively controlling each control section. The main body section 14 is equipped with a paper feed cassette section 16 and a printer section 18.

The scanner 12 reads a document image. The controller panel 13 is equipped with input keys 13*a* and a display section 13*b*. For example, the input keys 13*a* receive input of a user. For example, the display section 13*b* is a touch panel type. The display section 13*b* receives the input of the user and carries out display to the user.

The paper feed cassette section 16 is equipped with a paper feed cassette 16*a* and a pickup roller 16*b*. The paper feed cassette 16*a* houses a sheet P serving as the image receiving medium. The pickup roller 16*b* takes out the sheet P from the paper feed cassette 16*a*.

The paper feed cassette 16*a* feeds an unused sheet P. The paper feed tray 17 feeds the unused sheet P through a pickup roller 17*a*.

The printer section 18 forms an image. For example, the printer section 18 executes image formation of the document image read with the scanner 12. The printer section 18 is equipped with an intermediate transfer belt 21. The printer section 18 supports the intermediate transfer belt 21 with a backup roller 40, a driven roller 41 and a tension roller 42. The backup roller 40 is equipped with a driving section (not shown). The printer section 18 rotates the intermediate transfer belt 21 in an arrow m direction.

The printer section 18 is equipped with 4 sets of image forming stations 22Y, 22M, 220 and 22K. The image forming stations 22Y, 22M, 220 and 22K are used to form Y (yellow), M (magenta), C (cyan) and K (black) images respectively. The image forming stations 22Y, 22M, 220 and 22K are arranged below the intermediate transfer belt 21 along the rotation direction of the intermediate transfer belt 21 in parallel.

The printer section 18 is equipped with cartridges 23Y, 23M, 230 and 23K over the image forming stations 22Y, 22M, 220 and 22K. The cartridges 23Y, 23M, 230 and 23K store Y (yellow), M (magenta), C (cyan) and K (black) toners for replenishment, respectively.

Hereinafter, among the image forming stations 22Y, 22M, 220 and 22K, the image forming station 22Y of Y (yellow) is described as an example. Furthermore, as the image forming stations 22M, 220 and 22K have the same structure as the image forming station 22Y, the detailed description thereof is omitted.

The image forming station 22Y is equipped with an electrostatic charger 26, an exposure scanning head 27, developing device 28 and a photoconductor cleaner 29. The electrostatic charger 26, the exposure scanning head 27, the developing device 28 and the photoconductor cleaner 29 are arranged around the photoconductive drum 24 rotating in an arrow n direction.

The image forming station 22Y is equipped with a primary transfer roller 30. The primary transfer roller 30 faces the photoconductive drum 24 across the intermediate transfer belt 21.

The image forming station 22Y exposes the photoconductive drum 24 with the exposure scanning head 27 after the photoconductive drum 24 is charged by the electrostatic charger 26. The image forming station 22Y forms an electrostatic latent image on the photoconductive drum 24. The developing device 28 uses a two-component developing agent composed of the toner and a carrier to develop the electrostatic latent image on the photoconductive drum 24.

The primary transfer roller 30 primarily transfers a toner image formed on the photoconductive drum 24 onto the intermediate transfer belt 21. The image forming stations 22Y, 22M, 22C and 22K form a color toner image on the intermediate transfer belt 21 through the primary transfer roller 30. The color toner image is formed by overlapping Y (yellow), M (magenta), C (cyan) and K (black) toner images in order. The photoconductor cleaner 29 removes the toner remaining on the photoconductive drum 24 after the primary transfer.

The printer section 18 is equipped with a secondary transfer roller 32. The secondary transfer roller 32 faces the backup roller 40 across the intermediate transfer belt 21. The secondary transfer roller 32 secondarily transfers the color toner image on the intermediate transfer belt 21 onto the sheet P entirely. The sheet P is fed from the paper feed cassette section 16 or a manual feed tray 17 along a conveyance path 33.

The printer section 18 is equipped with a belt cleaner 43 facing a driven roller 41 across the intermediate transfer belt 21. The belt cleaner 43 removes the toner remaining on the intermediate transfer belt 21 after the secondary transfer. The image forming section contains the intermediate transfer belt 21, 4 sets of the image forming stations (22Y, 22M, 22C and 22K) and the secondary transfer roller 32.

The printer section 18 is equipped with a register roller 33*a*, a fixing device 34 (fixing section), a conveyance roller 60 and a paper discharge roller 36 along the conveyance path 33. The printer section 18 is equipped with a guide member 80, the conveyance roller 60, a bifurcation section 70 and a reverse conveyance section 38 at the downstream side of the fixing device 34.

The guide member 80 guides the fixed sheet P towards the conveyance roller 60.

The conveyance roller 60 sends the sheet P guided from the guide member 80 to the bifurcation section 70.

The bifurcation section 70 sends the sheet P sent from the conveyance roller 60 to a paper discharge section 20 or the reverse conveyance section 38. In a case of duplex printing, the reverse conveyance section 38 reverses the sheet P sent from the bifurcation section 70 and conveys the sheet P to the direction of the register roller 33*a*. The MFP 10 forms the fixed toner image on the sheet P with the printer section 18 and discharges the paper to the paper discharge section 20.

Further, the MFP 10 is not limited to using a tandem developing system, and the number of the developing devices 28 therein is not limited. Alternatively, the MFP 10 may directly transfer the toner image from the photoconductive drum 24 onto the sheet P.

As stated above, the sheet P is conveyed from the paper feed cassette section 16 to the paper discharge section 20.

Hereinafter, in a conveyance direction v (refer to FIG. 2) of the sheet P, the paper feed cassette section 16 side is set to an "upstream side". And in the conveyance direction v of the sheet P (refer to FIG. 2), the paper discharge section 20 side is set to a "downstream side".

Hereinafter, main portions of the image forming apparatus 10 are described.

Figure 2:
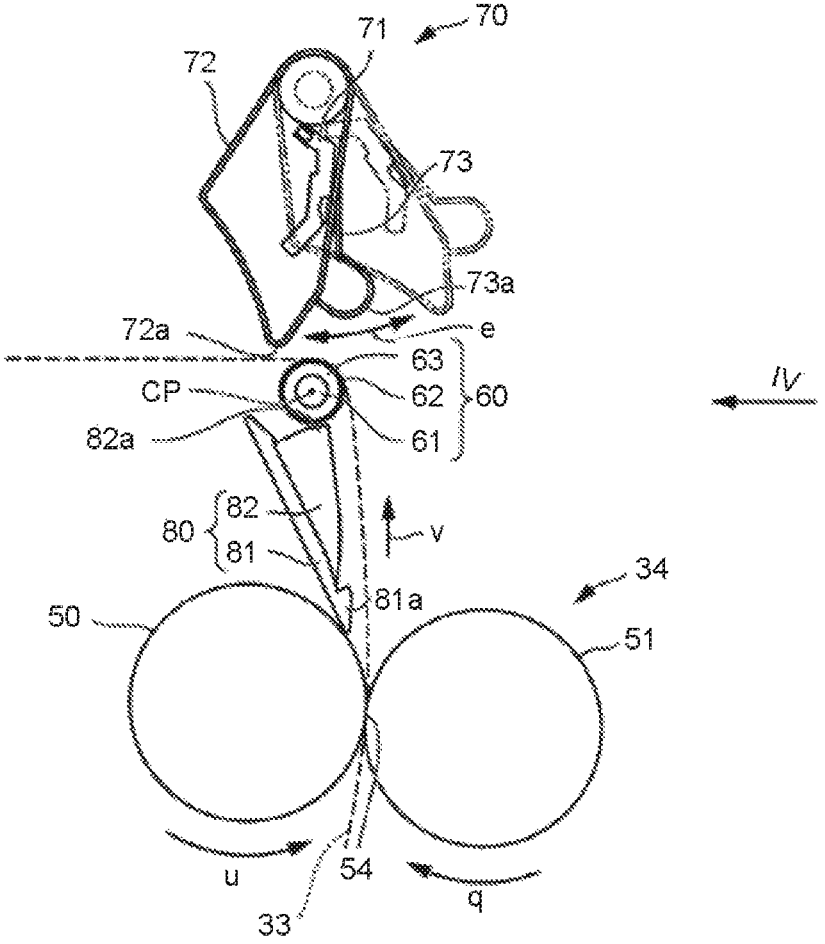
FIG. 2 is a side view of main portions of the image forming apparatus according to the embodiment.

FIG. 2 is a side view of the main portions of the image forming apparatus 10 according to the embodiment.

First, the fixing device 34 is described.

As shown in FIG. 2, the fixing device 34 is equipped with a heat roller 50 (heating section) and a press roller 51 (pressurizing section). The fixing device 34 fixes the toner image on the sheet P through the heat of the heat roller 50 and the pressurization of the press roller 51. The heat roller 50 is formed into a cylindrical shape. The heat roller 50 is a roller made from the metal. The Heating section includes the heat roller 50 and the lamp (not shown). The lamp is arranged inside the heat roller 50. The lamp heats the heat roller 50.

For example, the heat roller 50 has a resin layer of fluororesin and the like on the external peripheral surface of the roller the thickness of which is about 0.8 mm and which is made from aluminum. The heat roller 50 is driven by the press roller 51 to rotate in an arrow u direction. Further, the heat roller 50 may be independent of the press roller 51 and rotate in the arrow u direction.

The press roller 51 is the pressurizing section for pressurizing the heat roller 50. The press roller 51 pressurizes the heat roller 50 through a switching mechanism (not shown). The press roller 51 rotates in an arrow q direction through a motor (not shown). For example, the press roller 51 has an elastic layer of silicon rubber and the like on an external peripheral surface of a roller made from iron. The heat roller 50 faces the press roller 51. A nip 54 is formed between the heat roller 50 and the press roller 51. The sheet P passes through the nip 54 between the heat roller 50 and the press roller 51 along the conveyance path 33. In the conveyance direction v of the sheet P, the conveyance roller 60 is arranged at the downstream side of the fixing device 34. The conveyance roller 60 is arranged at the downstream side of the heat roller 50 and at the upstream side of the paper discharge section 20. The conveyance roller 60 initially conveys the fixed sheet P.

Next, the conveyance roller 60 is described.

Figure 3:
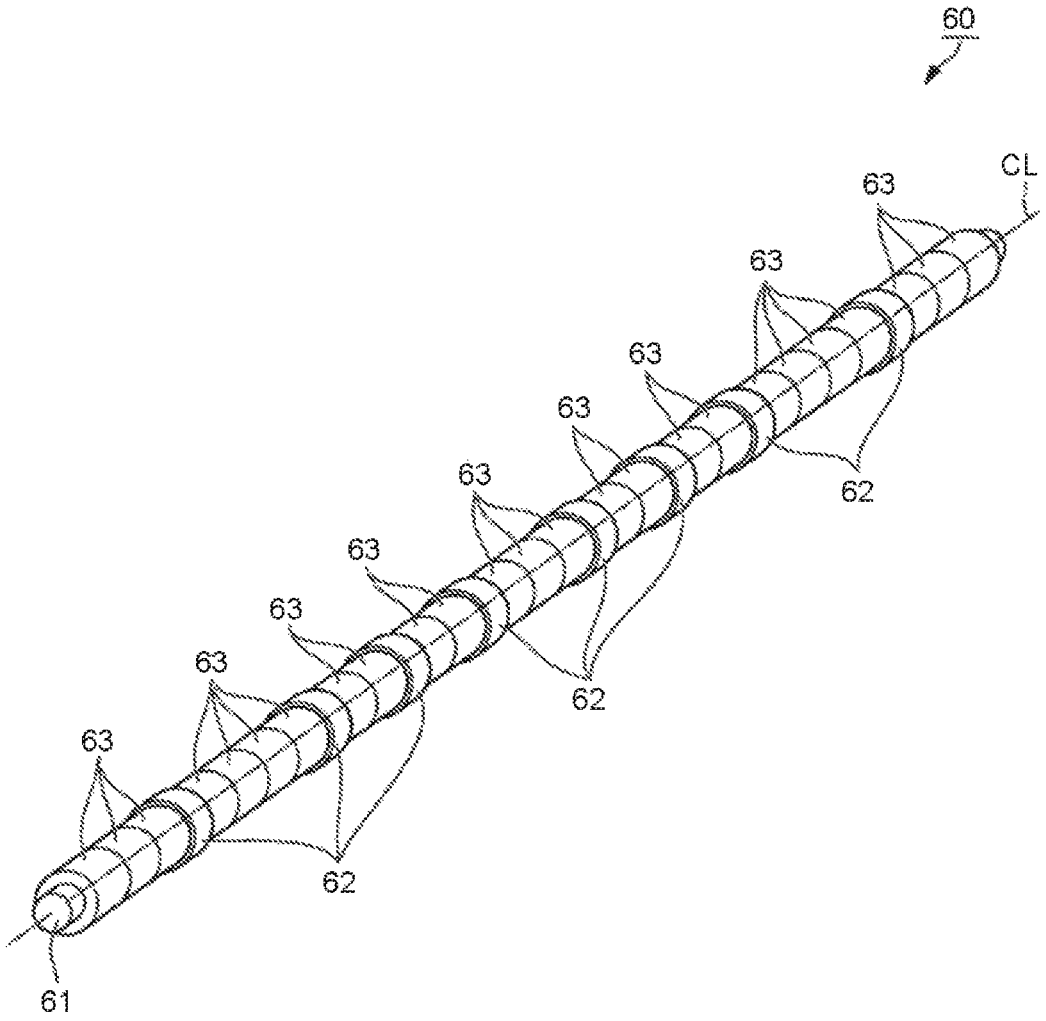
FIG. 3 is a perspective view of a conveyance roller according to the embodiment.

FIG. 3 is a perspective view of the conveyance roller 60 according to the embodiment.

As shown in FIG. 3, the conveyance roller 60 is equipped with an axis part 61, a large-diameter part 62 and a small-diameter part 63.

The axis part 61 is formed into a cylindrical shape extending in a direction orthogonal to the conveyance direction v (refer to FIG. 2) of the sheet P. The axis part 61 forms a rotation axis CL of the conveyance roller 60. For example, the axis part 61 is made from and contains the metal such as iron (Fe).

A mark CP in FIG. 2 indicates the center of a radial direction of the axis part 61. And a mark CL in FIG. 3 indicates an axis of the axis part 61. Hereinafter, a direction along the axis CL is referred to as an "axis direction", a direction orthogonal to the axis CL is referred to as a "radial direction", and a direction circulating around the axis CL is referred to as a "circumferential direction". Herein, the axis is equivalent to the rotation axis of the conveyance roller 60.

The large-diameter part 62 and the small-diameter part 63 are made from a member different from that of the axis part 61. The large-diameter part 62 and the small-diameter part 63 are fixed on the axis part 61. Both ends of the axis part 61 are supported by a supporting member (not shown) in a rotatable manner. The axis part 61 is rotatable in the circumferential direction. The large-diameter part 62 and the small-diameter part 63 are rotatable integrally with the axis part 61.

The large-diameter parts 62 are partially arranged on the axis part 61 in the axis direction. The large-diameter part 62 is formed into a cylindrical shape which has an outer diameter larger than that of the axis part 61. The large-diameter part 62 is a part where the conveyance roller 60 abuts against the sheet P. For example, the outer diameter of the large-diameter part 62 is set to about 8 mm. A plurality of the large-diameter parts 62 is arranged in the axis direction at intervals. For example, in the present embodiment, 8 large-diameter parts 62 are arranged in the axis direction at intervals. The large-diameter parts 62 have substantially identical size.

For example, the large-diameter part 62 is made from a fluororesin such as tetrafluoroethylene-ethylene copolymer (ETFE) and the like.

As a fluorine resin, tetrafluoroethylene-perfluoroalkyl vinyl ether copolymer (PFA), polytetrafluoroethylene (PTFE), tetrafluoroethylene-hexafluoropropylene copolymer (FEP), polyvinylidene fluoride (PVDF), polychlorotrifluoroethylene (PCTFE), chlorotrifluoroethylene-ethylene copolymer (ECTFE) and the like may be used.

The small-diameter parts 63 are arranged on parts of the axis part 61 avoiding the large-diameter parts 62 in the axis direction. The small-diameter part 63 is formed into a cylindrical shape which has an outer diameter larger than that of the axis part 61 and smaller than that of the large-diameter part 62. The frequency at which the small-diameter part 63 contacts with the sheet P is less when compared with the large-diameter part 62. For example, the outer diameter of the small-diameter part 63 is set to about 7.5 mm.

Further, the outer diameter of the small-diameter part 63 may be about 3 mm smaller than the outer diameter of the large-diameter part 62. In other words, when the outer diameter of the large-diameter part 62 is about X mm, the outer diameter of the small-diameter part 63 may be set to a size equal to or greater than (X−3) mm and smaller than X mm.

The small-diameter part 63 and the large-diameter part 62 are alternatively arranged in the axis direction. A plurality of the small-diameter parts 63 is together arranged across the large-diameter part 62 in the axis direction. For example, in the present embodiment, from one side (lower left side of the paper surface of FIG. 3) to the other side (upper right side of the paper surface of FIG. 3) of the axis direction, 3 small-diameter parts 63, 4 small-diameter parts 63, 2 small-diameter parts 63, 2 small-diameter parts 63, 3 small-diameter parts 63, 2 small-diameter parts 63, 2 small-diameter parts 63, 4 small-diameter parts 63 and 3 small-diameter parts 63 are arranged respectively across one large-diameter part 62. The total number of the small-diameter parts 63 is 25. The small-diameter parts 63 have substantially identical size.

The large-diameter part 62 and the small-diameter part 63 are made from different materials. For example, the small-diameter part 63 is made from polyacetal (POM).

Further, the small-diameter part 63 may be made from other plastics (synthetic resin). For example, as a plastic, vinyl chloride (PVC), polyethylene (PE), polypropylene (PP), polystyrene (PS), ABS resin (ABS), polymethyl methacrylate (PMMA), polyamide (PA), polycarbonate (PC), polybutylene terephthalate (PBT), polyethylene terephthalate (PET) and the like may be used.

The large-diameter part 62 and the small-diameter part 63 cover the axis part 61. Herein, the term "cover" refers to allowing the generation of a gap growing to an extent to which, in the axis direction, the sheet P does not contact the axis part 61 among a plurality of the small-diameter parts 63 together arranged and between the large-diameter part 62 and the small-diameter part 63. The sheet P comes into contact with the large-diameter part 62 and/or the small-diameter part 63 of the conveyance roller 60.

As stated above, as the conveyance roller 60 initially conveys the fixed sheet 2, the conveyance roller 60 easily bathes in water vapor generated by the sheet P. As the axis part 61 is made from the metal, compared with a case in which the axis part 61 is made from plastics, the dew condensation is easily generated in the axis part 61. However, according to the embodiment, as the axis part 61 in which the dew condensation is easily generated is covered by the large-diameter part 62 and the small-diameter part 63, the sheet P is difficult to be moistened.

Figure 4:
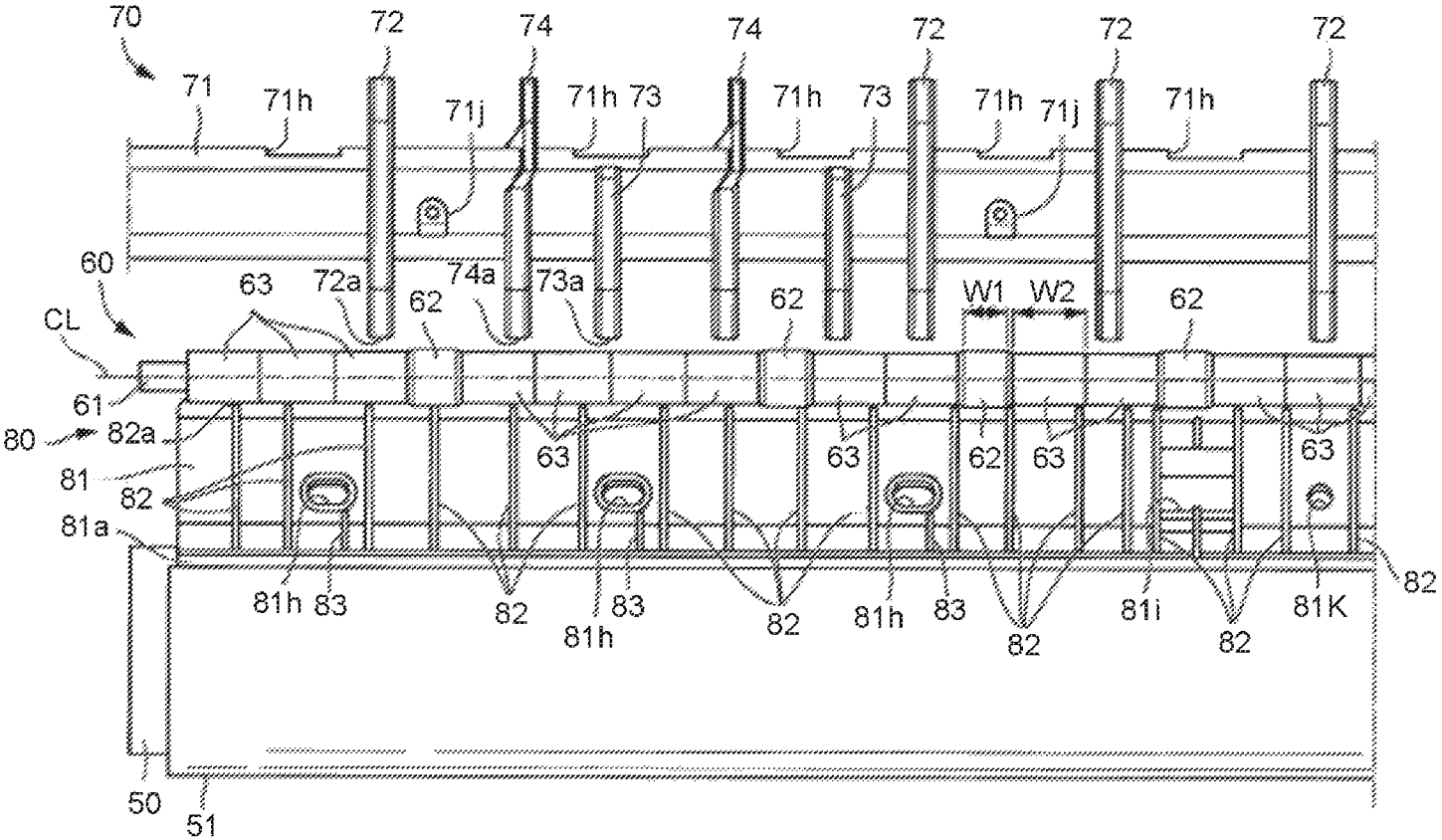
FIG. 4 is a diagram of FIG. 2 from an arrow IV.

FIG. 4 is a diagram of FIG. 2 from an arrow IV.

As shown in FIG. 4, in the axis direction, a width w1 of the large-diameter part 62 is smaller than a width w2 of the small-diameter part 63 (w1<w2). In the axis direction, the width w1 of the large-diameter part 62 is smaller than the arrangement interval of the large-diameter part 62. Herein, the "width w1" means the length of the large-diameter part 62 in the axis direction. The "width w2" means the length of the small-diameter part 63 in the axis direction.

As stated above, the arranged number (8) of the large-diameter parts 62 is smaller than that (25) of the small-diameter parts 63. In the axis direction, a total width (w1×8) of a plurality of the large-diameter parts 62 is smaller than a total width (w2×25) of a plurality of the small-diameter parts 63.

Next, the guide member 80 is described.

As shown in FIG. 1, the guide member 80, in the conveyance direction v of the sheet P, is arranged at the downstream side of the nip 54 of the fixing device 34 and at the upstream side of the conveyance roller 60. The guide member 80 is adjacent to the fixing device 34 and the conveyance roller 60 in the conveyance direction v of the sheet P. The fixed sheet P is guided towards the conveyance roller 60 through the guide member 80.

As shown in FIG. 4, the guide member 80 is equipped with a guide member main body 81, a plurality of guide plates 82 and a plurality of ribs 83. Each guide plate 82 and each rib 83 are partially arranged in the guide member main body 81 in a direction parallel to the axis direction.

The guide member main body 81 formed into a plate shape which extends in a direction parallel to the axis direction and slants with respect to the conveyance direction v when observed from the axis direction (side view of FIG. 2). As shown in FIG. 2, the guide member main body 81 is separated from the conveyance roller 60. A convex part 81*a* protruding to the conveyance path 33 side is formed on the part of the guide member math body 81 at the fixing device 34 side. As shown in FIG. 4, the convex part 81*a* extends in the direction parallel to the axis direction.

Further, a mark 81*h* in FIG. 4 indicates an elliptical opening section for opening the guide member main body 81 in a thickness direction thereof. A mark 81*i* in FIG. 4 indicates a rectangular opening section for opening the guide member main body 81 in the thickness direction thereof. A mark 81*k* in FIG. 4 indicates a circular opening section for opening the guide member main body 81 in the thickness direction thereof.

The guide plate 82 which linearly extends in a direction orthogonal to the axis direction is formed into a thick plate shape in the direction parallel to the axis direction. When observed from the axis direction (in the side view of FIG. 2), the guide plate 82 is formed into a triangular shape. When observed from the axis direction (in the side view of FIG. 2), a concave part 82*a* is formed at the top of the guide plate 82 which approaches the conveyance roller 60. When observed from the axis direction (in the side view of FIG. 2) the concave part 82*a* is formed into an arc shape along the periphery of the large-diameter part 62 of the conveyance roller 60.

As shown in FIG. 4, the rib 83 which linearly extends in the direction orthogonal to the axis direction is formed into a thick plate shape in the direction Parallel to the axis direction. In the direction orthogonal to the axis direction, the rib 83 is shorter than the guide plate 82. The rib 83 stretches across a space between the convex part 81*a* and the opening section 81*h* of the guide member main body 81.

A plurality of the guide plates 82 is arranged at intervals in the extending direction of the guide member main body 81. Each guide plate 82 functions as a guiding section for guiding the fixed sheet P towards the conveyance roller 60. Each guide plate 82 also functions as a rib for strengthening the guide member main body 81.

In the direction orthogonal to the axis direction, the guide plates 82 have substantially identical length. Spaces between the concave parts 82*a* of the guide plate 82 and the axis part 61 of the conveyance roller 60 are substantially identical.

In the direction orthogonal to the axis direction, each concave part 82*a* faces the large-diameter part 62 or the small-diameter part 63.

Next, the bifurcation section 70 is described.

As shown in FIG. 1, the bifurcation section 70 is arranged at the downstream side of the conveyance roller 60 in the conveyance direction v of the sheet P. The bifurcation section 70 is adjacent to the conveyance roller 60 in the conveyance direction v of the sheet P. Herein, the bifurcation section 70 is equivalent to a "conveyance guide" recorded in claims.

As shown in FIG. 2, the bifurcation section 70 can swing in an arrow e direction. As shown in FIG. 1, when the bifurcation section 70 swings to one side (position shown by a dotted line of FIG. 2), the sheet P sent from the conveyance roller 60 is sent towards the paper discharge section 20. On the other hand, when the bifurcation section 70 swings to the other side (a position shown by a solid line of FIG. 2), the Sheet P sent from the conveyance roller 60 is sent towards the reverse conveyance section 38.

As shown in FIG. 4 the bifurcation section 70 is equipped with a bifurcation section main body 71 and three kinds of guide plates 72, 73 and 74 (a first guide plate 72, a second guide plate 73 and a third guide plate 74). Each of the guide plates 72, 73 and 74 is partially arranged in the bifurcation section main body 71 in the direction parallel to the axis direction.

The bifurcation section main body 71 which extends in the direction parallel to the axis direction is formed into a crooked shape when observed from the axis direction (in the side view of FIG. 2). The bifurcation section main body 71 is separated from the conveyance roller 60.

Further, marks 71*h* in FIG. 4 indicate a plurality of notches formed at a part opposite to the conveyance roller 60 in the bifurcation section main body 71. A mark 71*j* in FIG. 4 indicates an installation boss for installing the bifurcation section main body 71 in the supporting member (not shown).

The first guide plate 72 which linearly extends in the direction orthogonal to the axis direction is formed into a thick plate shape in the direction parallel to the axis direction. The first guide plate 72 is equipped with a protrusion 72*a* protruding towards the conveyance roller 60. The protrusion 72*a* in the first guide plate 72 protrudes to the conveyance roller 60 side with respect to the bifurcation section main body 71.

The second guide plate 73 which linearly extends in the direction orthogonal to the axis direction is formed into a plate shape in the direction parallel to the axis direction. In the direction orthogonal to the axis direction, the second guide plate 73 is shorter than the first guide plate 72. The second guide plate 73 is equipped with a protrusion 73*a* protruding towards the conveyance roller 60. The protrusion 73*a* in the second guide plate 73 protrudes towards the conveyance roller 60 with respect to the bifurcation section main body 71.

The third guide plate 74 which extends like a crank in the direction orthogonal to the axis direction is formed into a thick plate shape in the direction parallel to the axis direction. In the direction orthogonal to the axis direction, the third guide plate 74 is substantially as long as the first guide plate 72. The third guide plate 74 is equipped with a protrusion 74*a* protruding towards the conveyance roller 60. The protrusion 74*a* in the third guide plate 74 protrudes towards the conveyance roller 60 side with respect to the bifurcation section main body 71.

A plurality of the guide plates 72, 73 and 74 is arranged at intervals in the extending direction of the bifurcation section main body 71. Each of the guide plates 72, 73 and 74 functions as a guiding section for guiding the sheet P sent from the conveyance roller 60 to the paper discharge section 20 or the reverse conveyance section 38 (refer to FIG. 1) Each of the guide plates 72, 73 and 74 also functions as a rib for strengthening the bifurcation section main body 71.

The arrangement of each of the guide plates 72, 73 and 74 is set in accordance with the size of the sheet P. For example, Each of the guide plates 72, 73 and 74 is arranged at the inner side of a width direction 5 mm~6 mm away from the width of the sheet P. Herein, the "width of the sheet P" means a length of the sheet P in the direction orthogonal to the conveyance direction v (refer to FIG. 2). The "inner side in the width direction" means the inner side of the sheet P in the width direction of the sheet P.

In the direction orthogonal to the axis direction, the protrusions 72*a*, 73*a* and 74*a* of the guide plates 72, 73 and 74 have substantially identical length. Spaces respectively between the protrusion ends, of the protrusions 72*a*, 73*a*, 74*a* and the axis part 61 of the conveyance roller 60 are substantially identical.

In the axis direction, the large-diameter part 62 avoids each of the protrusions 72*a*, 73*a* and 74*a*. In other words, in the direction orthogonal to the axis direction, the large-diameter part 62 does not face each of the protrusions 72*a*, 73*a* and 74*a*. On the other hand, in the direction orthogonal to the axis direction, the small-diameter part 63 faces each of the protrusions 72*a*, 73*a* and 74*a*.

Incidentally, through the water vapor generated when the sheet P is heated at the nip 54, there is a case in which the dew condensation is generated in the conveyance roller if the dew condensation is generated in the conveyance roller, there is a possibility that the sheet P is moistened when the sheet P is conveyed.

Particularly, if a part abutting against the sheet P (hereinafter, referred to as "sheet abutting part") in the conveyance roller 60 is made from the metal such as iron, the generation of the dew condensation becomes obvious. If the sheet abutting part is made from the metal, as the sheet abutting part itself is excessively heated, the sheet abutting part easily adheres to the sheet P, and the conveyance failure of the sheet P easily occurs. If the sheet abutting part adheres to the sheet P, because of the rubbing between the sheet abutting part and the sheet P, the image stripe and gloss unevenness easily occur. If the sheet abutting part is made from the metal, as the sheet abutting part is excessively cooled, the heat of the sheet is rapidly taken, and the gloss unevenness easily occurs.

On the other hand, in order to suppress the generation of the dew condensation, the conveyance failure of the sheet P, the image stripe and the gloss unevenness, it is considered to form the sheet abutting part with a silicon sponge the heat capacity of which is smaller than the metal. However, as the silicon sponge is very expensive, if the sheet abutting part is made from the silicon sponge, the cost thereof becomes high.

According to the embodiment, through partially arranging the large-diameter part 62 in the axis direction, an contact area of the conveyance roller 60 and the sheet P can be reduced compared with a case in which a roller (passing roller) which is long enough to contact with the whole width of the sheet P is arranged. Through reducing the contact area of the conveyance roller 60 and the sheet P, even if the dew condensation is generated in the conveyance roller 60, the sheet P is difficult to be moistened. Thus, the moistness of the sheet P can be suppressed.

Through arranging the small-diameter part 63 on the conveyance roller 60, as the space between the small-diameter part 63 and the large-diameter part 62 in the radial direction can be reduced, the waviness of the sheet P in the conveyance can be reduced compared with a case in which the small-diameter part 63 is not arranged. Thus, the conveyance failure such as paper jam of the sheet P can be suppressed.

Through arranging the outer diameter of the small-diameter part 63 to be about 3 mm smaller than the outer diameter of the large-diameter part 62, the waviness of the sheet P in the conveyance can be efficiently reduced compared with a case in which the outer diameter of the small-diameter part 63 is above 3 mm smaller than the outer diameter of the large-diameter part 62.

Through arranging a plurality of the large-diameter parts 62 at intervals in the axis direction, as the sheet abutting parts disperse in the axis direction the winding of the sheet P in the conveyance can be suppressed compared with a case in which the large-diameter parts 62 are partially arranged in a centralized manner in the axis direction. Thus, the conveyance failure of the sheet P can be suppressed.

In the axis direction, the width w1 of the large-diameter part 62 is smaller than the width w2 of the small-diameter part 63 (w1<w2). Through arranging the width w1 of the large-diameter part 62 to be smaller than the width w2 of the small-diameter part 63, the contact area between the conveyance roller 60 and the sheet P can be reduced comp red with a case in which the width w1 of the large-diameter part 62 is equal to or larger than the width w2 of the small-diameter part 63. Thus, the moistness of the sheet P can be effectively suppressed.

As the axis part 61 is rotatable in the circumferential direction, compared with a case in which a fixed guiding rib is arranged, the image stripe and the gloss unevenness caused by the rubbing of the guide rib and the sheet P do not occur.

As the axis part 61 is made from the metal, compared with a case in which the axis part 61 is made from the plastic, the axis part 61 has high hardness. Thus, the conveyance of the sheet P can be improved.

Even if the axis part 61 is made from the metal, as the axis part 61 in which the dew condensation is easily generated is covered by the large-diameter part 62 and the small-diameter part 63, the sheet P is difficult to be moistened.

Through forming the large-diameter part 62 with fluororesin, compared with a case in which the large-diameter part 62 is made from the metal, the generation of the dew condensation can be suppressed. Thus, the moistness of the sheet P can be suppressed.

Compared with a case in which the large-diameter part 62 is made from the metal, as that the sheet abutting part becomes excessively hot can be suppressed, that the sheet abutting part adheres to the sheet P can be suppressed. Thus, the conveyance failure of the sheet P, the image stripe and the gloss unevenness can be suppressed.

Compared with a case in which the large-diameter part 62 is made from the metal, as that the sheet abutting part is excessively cooled can be suppressed, that the heat of the sheet P is rapidly taken can be suppressed. Thus, the gloss unevenness can be suppressed.

As fluororesin is cheaper than the silicon sponge, compared with a case in which the sheet abutting part is made from the silicon sponge, low cost can be achieved.

Through forming the large-diameter part 62 and the small-diameter part 63 with different materials, compared with a case in which the large-diameter part 62 and the small-diameter part 63 are formed with the identical material, the freedom in design of the conveyance roller 60 can be improved. For example, as the large-diameter part 62 has a function of the sheet abutting part, the large-diameter part 62 can be made from the material difficult to adhere to the fixed toner image. On the other hand, as the small-diameter part 63 has a function of a waviness suppression section of the sheet P, the small-diameter part 63 can be made from a material cheaper than the forming material of the large-diameter part 62.

Through forming the large-diameter part 62 with ETFE and forming the small-diameter part 63 with POM, the following effect can be achieved. As ETFE is more difficult to adhere to the fixed toner image compared with POM, compared with a case in which the large-diameter part 62 is made from POM, the image stripe can be suppressed. As POM is cheaper than ETFE, compared with a case in which the large-diameter part 62 and the small-diameter part 63 are both made from ETFE, low cost can be achieved.

As the large-diameter part 62 avoids each of the protrusions 72*a*, 73*a* and 74*a* in the axis direction, the contact of the large-diameter part 62 with each of the protrusions 72*a*, 73*a* and 74*a* can be avoided. Through making the large-diameter part 62 avoid each of the protrusions 72*a*, 73*a* and 74*a* in the axis direction, the conveyance roller 60 (small-diameter part 63) can be adjacent to each of the protrusions 72*a*, 73*a* and 74*a*. Through enabling the conveyance roller 60 (small-diameter part 63) to be adjacent to each of the protrusions 72*a*, 73*a* and 74*a*, the bend of the sheet P in the conveyance can be small. Thus, the conveyance failure of the sheet P can be suppressed.

According to the image forming apparatuses according to at least one foregoing embodiment, even if the dew condensation is generated in the conveyance roller 60, as the sheet P is difficult to be moistened, the moistness of the sheet P can be suppressed.

Hereinafter, modifications are described.

For example, as the fixing member, the fixing belt may be arranged. The fixing belt is equipped with a conductive layer. As the conductive layer of the fixing belt is heated through an electromagnetic induction heating system (hereinafter, referred to as an "IH system"), the conductive layer generates heat through an induction current. Thus, in the IH system, the moistness of the sheet P can be suppressed.

The large-diameter part 62 and the small-diameter part 63 are rotatable integrally with the axis part 61; however, the present invention is not limited to this. For example, the large-diameter part 62 and the small-diameter part 63 may be separately rotatable independently of the axis part 61.

The large-diameter part 62 and the small-diameter part 63 are made from a member different from that of the axis part 61; however, the present invention is not limited to this. For example, the large-diameter part 62 and the small-diameter part 63 may be made from the same member as the axis part 61 and be integrated with the axis part 61. For example, through removing the cylindrical member made from metal or resin line, the axis part 61, the large-diameter part 62 and the small-diameter part 63 may be formed in an integrated manner.

It is not limited that the large-diameter part 62 is made from fluororesin. For example, the large-diameter part 62 may be made from POM. As POM is cheaper than the silicon sponge, low cost can be achieved compared with a case in which the sheet abutting part is made from the silicon sponge.

The large-diameter part 62 and the small-diameter part 63 may be made from the identical material. Compared with a case in which the large-diameter part 62 and the small-diameter part 63 are made from different materials, the management of the material can become easy. For example, through forming the large-diameter part 62 and the small-diameter part 63 with POM, as POM is cheaper than ETFE, low cost can be achieved compared with a case in which the large-diameter part 62 and the small-diameter part 63 are made from ETFE.

In the conveyance roller 60 initially conveying the fixed sheet P, the axis part 61 in which the dew condensation is easily generated is covered with the large-diameter part 62 and the small-diameter part 63; however, the present invention is not limited to this. For example, in a roller in which the dew condensation is easily generated through the water vapor generated by the sheet P, the axis part 61 in which the dew condensation is easily generated may be covered with the large-diameter part 62 and the small-diameter part 63. Herein, a roller for secondarily conveying the fixed sheet P from the beginning is referred to as a "secondary conveyance roller". Through the water vapor generated by the sheet P, in addition to the conveyance roller 60 for initially conveying the fixed sheet P, there is a case in which the dew condensation is also generated in the secondary conveyance roller. Thus, if the dew condensation is also generated in the secondary conveyance roller, in the secondary conveyance roller, the axis part 61 in which the dew condensation is easily generated may be covered with the large-diameter part 62 and the small-diameter part 63. That is, at least in the conveyance roller 60 for initially conveying the fixed sheet P, the axis part 61 in which the dew condensation is easily generated may be covered with the large-diameter part 62 and the small-diameter part 63.

In the foregoing embodiment, the function of the image forming apparatus may be realized by a computer. In this case, a program for realizing the function is recorded in a computer-readable recording medium, and the function is realized through reading the program recorded in the recording medium into a computer system to be executed. Further, "computer system" referred herein contains an OS or hardware such as a peripheral device. The "computer-readable recording medium" refers to a storage device such as a flexible disk, a magneto-optical disk, a ROM, a portable medium such as a CDROM, or a hard disk built in the computer system. Further, the "computer-readable recording medium" may include a storage device for dynamically holding a program for a short time like a communication line in a case of sending a program via a communication circuit such as a network such as the Internet or a telephone circuit or a storage device for holding a program for a certain time like a volatile memory inside the computer system serving as a server or a client in that case. The program may be a program for realizing a part of the mentioned-above functions or may realize the mentioned-above functions in combination with a program already recorded in the computer system.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a fixing device configured to fix an image on an image receiving medium passing through a nip between a heating section and a pressurizing section through heat of the heating section and pressurization of the pressurizing section; and a conveyance roller arranged at a downstream side of the fixing device in a conveyance direction of the image receiving medium configured to convey the fixed image receiving medium, the conveyance roller comprising:

an axis part made from a metal;

a plurality of large-diameter parts each configured to have an outer diameter larger than that of the axis part, the plurality of large-diameter parts are made from a fluororesin; and a plurality of small-diameter parts each configured to have an outer diameter which is larger than that of the axis part and smaller than that of the plurality of large-diameter parts, the plurality of small-diameter parts are made from polyacetal, wherein the plurality of large-diameter parts and the plurality of small-diameter parts cover the axis part so that the image receiving medium does not contact the axis part.

2. The image forming apparatus according to claim 1, further comprising:

a conveyance guide arranged at the downstream side of the fixing device in the conveyance direction of the image receiving medium and at an upstream side of the conveyance roller in the conveyance direction of the image receiving medium, wherein the conveyance guide is equipped with a plurality of protrusions protruding towards the conveyance roller; and the plurality of large-diameter parts avoid contact with the plurality of protrusions.

3. A method of reducing moisture transferred to an image receiving medium generated during fixing processing comprising:

conveying the image receiving medium with a conveyance roller comprising:

an axis part made from a metal;

a plurality of large-diameter parts each configured to have an outer diameter larger than that of the axis part, the plurality of large-diameter parts are made from a fluororesin; and a plurality of small-diameter parts each configured to have an outer diameter which is larger than that of the axis part and smaller than that of the plurality of large-diameter parts, the plurality of small-diameter parts are made from polyacetal, wherein the plurality of large-diameter parts and the plurality of small-diameter parts cover the axis part so that the image receiving medium does not contact the axis part.

4. An image forming apparatus, comprising:

a fixing device configured to fix an image on an image receiving medium passing through a nip between a heating section and a pressurizing section through heat of the heating section and pressurization of the pressurizing section; and a conveyance roller arranged at a downstream side of the fixing device in a conveyance direction of the image receiving medium configured to convey the fixed image receiving medium, the conveyance roller comprising:

an axis part made from a metal;

a plurality of large-diameter parts each configured to have an outer diameter larger than that of the axis part, the plurality of large-diameter parts are made from a fluororesin; and a plurality of small-diameter parts each configured to have an outer diameter which is larger than that of the axis part and smaller than that of the plurality of large-diameter parts, the plurality of small-diameter parts are made from polyacetal, wherein in an axis direction of the conveyance roller, widths of the plurality of large-diameter parts are smaller than widths of the plurality of small-diameter parts.

5. The image forming apparatus according to claim 4, wherein the plurality of large-diameter parts and the plurality of small-diameter parts cover the axis part.

6. The image forming apparatus according to claim 4, further comprising:

a conveyance guide arranged at the downstream side of the fixing device in the conveyance direction of the image receiving medium and at an upstream side of the conveyance roller in the conveyance direction of the image receiving medium, wherein the conveyance guide is equipped with a plurality of protrusions protruding towards the conveyance roller; and the plurality of large-diameter parts avoid contact with the plurality of protrusions.

* * * * *